US012245674B2

(12) United States Patent
Alicea-García

(10) Patent No.: US 12,245,674 B2
(45) Date of Patent: Mar. 11, 2025

(54) TOOLS FOR REMOVING NAIL POLISH AND BUFFING NAILS

(71) Applicant: Johanna Alicea-García, San Juan, PR (US)

(72) Inventor: Johanna Alicea-García, San Juan, PR (US)

( * ) Notice: Subject to any disclaimer, the term of this patent is extended or adjusted under 35 U.S.C. 154(b) by 0 days.

(21) Appl. No.: 18/138,959

(22) Filed: Apr. 25, 2023

(65) Prior Publication Data

US 2023/0255338 A1 Aug. 17, 2023

Related U.S. Application Data

(62) Division of application No. 16/282,228, filed on Feb. 21, 2019, now Pat. No. 11,690,433.

(60) Provisional application No. 62/633,524, filed on Feb. 21, 2018.

(51) Int. Cl.

| | |
|---|---|
| ***A45D 29/00*** | (2006.01) |
| ***A45D 29/12*** | (2006.01) |
| ***A45D 29/17*** | (2006.01) |

(52) U.S. Cl.

CPC ..... *A45D 29/007* (2013.01); *A45D 29/12* (2013.01); *A45D 29/17* (2013.01); *A45D 2200/1018* (2013.01)

(58) Field of Classification Search

CPC ..... A45D 29/00; A45D 29/004; A45D 29/04; A45D 29/05; A45D 29/06; A45D 29/11; A45D 29/12; A45D 29/14; A45D 29/16; A45D 29/17; A45D 29/18; A45D 2200/1018; A45D 31/00

See application file for complete search history.

(56) References Cited

U.S. PATENT DOCUMENTS

| | | | |
|---|---|---|---|
| 743,685 | A | 11/1903 | Broadhurst |
| 893,004 | A | 7/1908 | Miller |
| 1,007,816 | A | 11/1911 | Stubenrauch |
| 1,667,570 | A | 4/1928 | Thelander |
| D92,088 | S | 4/1934 | Johnson |
| D137,554 | S | 3/1944 | Herb |
| 2,442,051 | A | 5/1948 | Luscri |

(Continued)

*Primary Examiner* — Rachel R Steitz
*Assistant Examiner* — Karim Asqiriba
(74) *Attorney, Agent, or Firm* — Reyes Law Services; Hector M. Reyes Rivera

(57) ABSTRACT

A nail care tool having an ergonomic elongated handle, an operational head, and a male/female system or mechanism suitable to connect or disconnect the elongated handle and the operational head is presented. The tool also has a removable scraper or end tip inserted in one of the ends of the handle, useful in cleaning critical cuticle areas. The operational head may have different shapes and its external surface has different operational lining materials commonly used in the nail care and maintenance processes. In some embodiments, the lining material on the operational head is an absorbent material, while in other embodiments, it is an abrasive material. By connecting the ergonomic handle to the operational removable head having the absorbent material, the tool is suitable to be used as a nail polish remover applicator, meaning being able to remove nail polishes. On the other hand, by engaging the ergonomic handle to the operational removable head having an abrasive material as a lining material, the tool is conveniently used as a nail buffing tool.

15 Claims, 8 Drawing Sheets

(56) References Cited

U.S. PATENT DOCUMENTS

| | | | | |
|---|---|---|---|---|
| 2,713,693 | A | 7/1955 | Johnson | |
| 2,804,636 | A | 9/1957 | Sadler | |
| 2,841,809 | A | 7/1958 | Oliver | |
| 3,179,327 | A | 4/1965 | Burton et al. | |
| D202,874 | S | 11/1965 | Luedtkd et al. | |
| 3,317,944 | A | 5/1967 | Napier, Sr. et al. | |
| 3,324,855 | A | 6/1967 | Heimlich | |
| 3,369,267 | A | 2/1968 | Friedland et al. | |
| 3,369,553 | A | 2/1968 | Keesee | |
| 3,519,364 | A | 7/1970 | Thuhan | |
| 3,759,259 | A | 9/1973 | Truhan | |
| 3,759,375 | A | 9/1973 | Nappi | |
| 3,891,331 | A | 6/1975 | Avery | |
| 4,148,318 | A | 4/1979 | Meyer | |
| 4,366,828 | A | 1/1983 | Hokama | |
| 4,483,356 | A | 11/1984 | Kales | |
| 4,627,758 | A | 12/1986 | Winthrop | |
| 4,701,168 | A | 10/1987 | Gammons | |
| 4,884,913 | A | 12/1989 | Smith et al. | |
| 4,893,956 | A | 1/1990 | Wojcik et al. | |
| 4,998,839 | A | 3/1991 | Bashir | |
| D329,718 | S | 9/1992 | Sulik | |
| D369,438 | S | 4/1996 | Resler | |
| 5,642,913 | A | 7/1997 | Brown | |
| 5,762,077 | A * | 6/1998 | Griffiths, Jr. | A45D 29/04 206/229 |
| 5,855,212 | A | 1/1999 | Walker | |
| 5,899,210 | A | 5/1999 | Letherby et al. | |
| 5,996,590 | A * | 12/1999 | Steege | A45D 29/04 132/73 |
| 6,035,859 | A | 3/2000 | Antonopoulos-McIvor | |
| 6,102,048 | A | 8/2000 | Baker | |
| 6,405,735 | B1 | 6/2002 | Dockery | |
| 6,786,667 | B1 | 9/2004 | Thomas et al. | |
| 7,127,768 | B2 | 10/2006 | Blum et al. | |
| 7,159,265 | B2 | 1/2007 | Soller et al. | |
| 7,458,381 | B2 | 12/2008 | Shepard | |
| D666,772 | S | 9/2012 | Park | |
| D710,053 | S * | 7/2014 | Abbott | D28/7 |
| 9,113,691 | B1 | 8/2015 | Picazo et al. | |
| 2005/0055831 | A1* | 3/2005 | Lam | A45D 29/16 30/26 |
| 2005/0081870 | A1 | 4/2005 | Jancik | |
| 2008/0115302 | A1 | 5/2008 | Kilkenny et al. | |
| 2008/0142405 | A1* | 6/2008 | Knapp | A45D 29/007 206/581 |
| 2009/0090376 | A1* | 4/2009 | Wang | A61M 35/006 132/75.3 |
| 2009/0152132 | A1 | 6/2009 | Wang | |
| 2010/0083976 | A1* | 4/2010 | Montana-Selers | A45D 34/042 132/73 |
| 2012/0192893 | A1* | 8/2012 | Anderson | A45D 24/12 132/271 |
| 2013/0028651 | A1* | 1/2013 | Kaufman | A61L 2/00 401/133 |
| 2014/0182073 | A1 | 7/2014 | Mitchell | |
| 2015/0150353 | A1* | 6/2015 | Yiu | A61B 17/54 132/75.6 |
| 2017/0303658 | A1* | 10/2017 | Becker | A45D 29/007 |
| 2018/0310687 | A1* | 11/2018 | Gomes | A45D 29/04 |
| 2021/0267346 | A1* | 9/2021 | Balmer | A45D 29/04 |

* cited by examiner

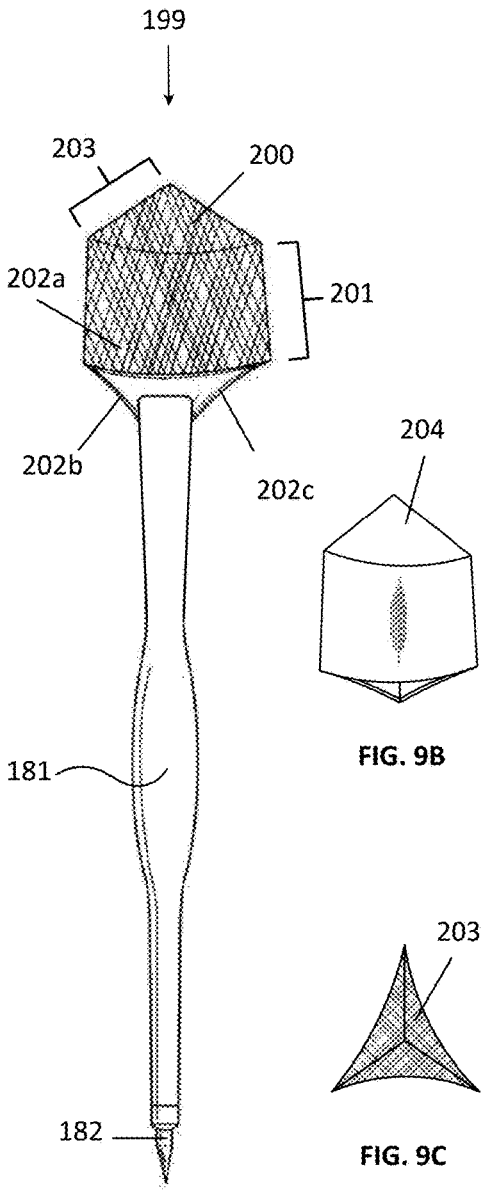
FIG. 9A
FIG. 9B
FIG. 9C
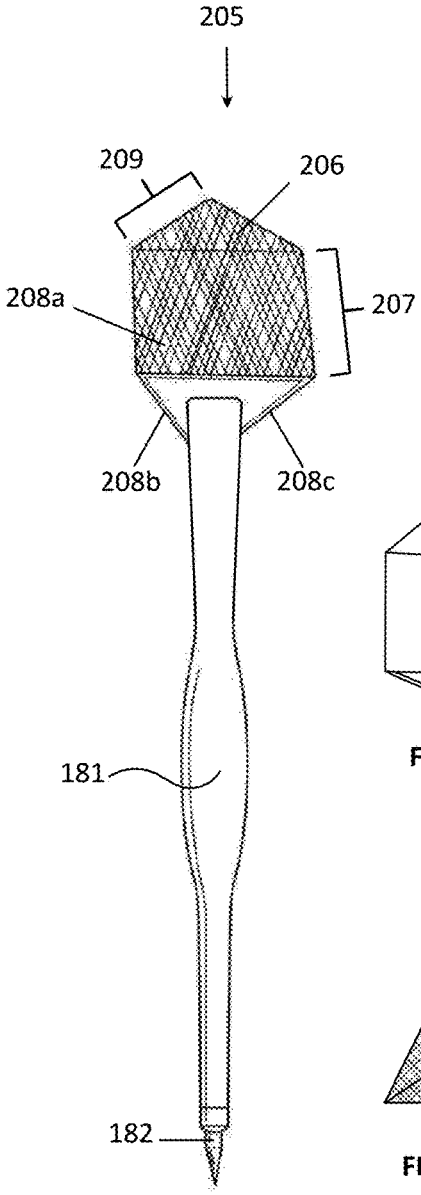
FIG. 10A
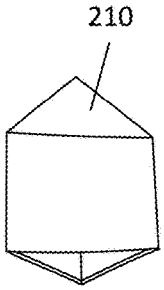
FIG. 10B
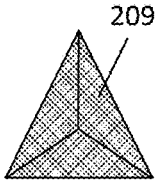
FIG. 10C

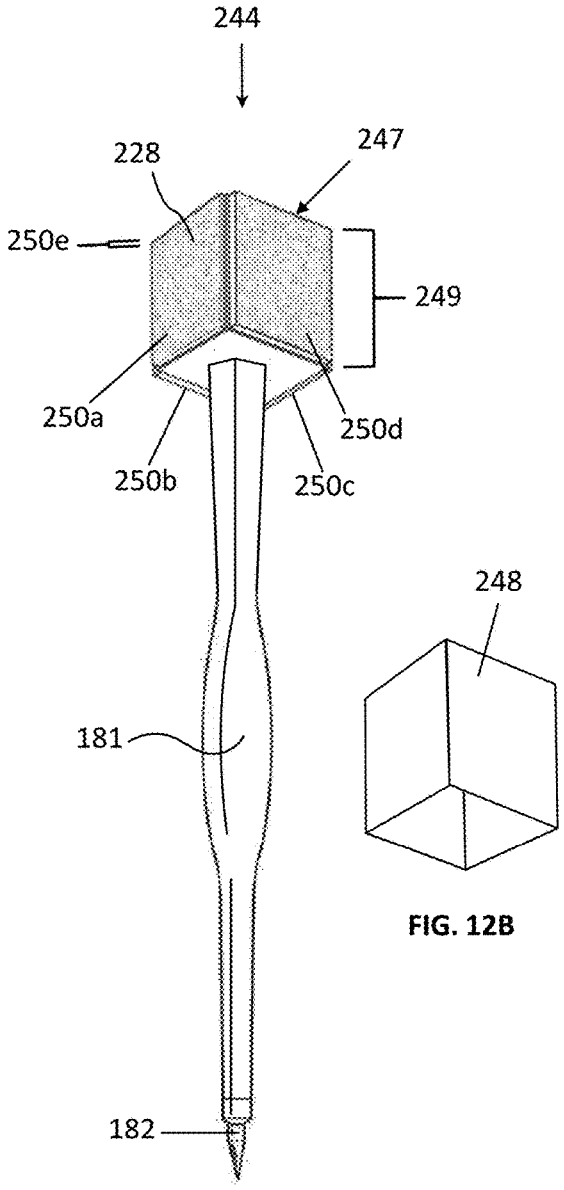
FIG. 12B
FIG. 12A
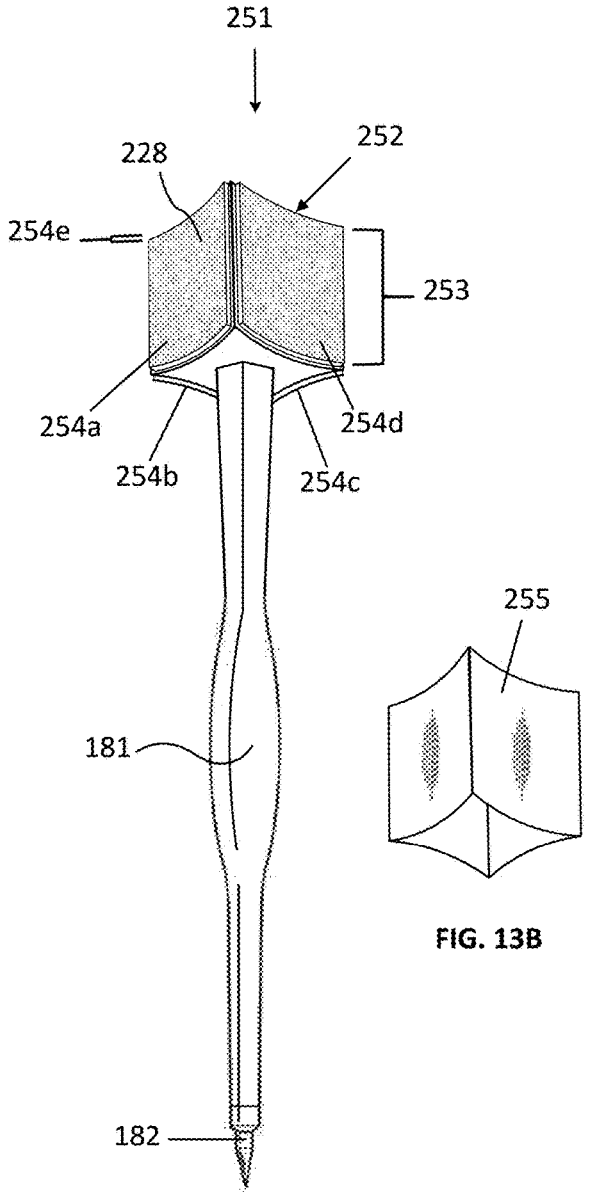
FIG. 13B
FIG. 13A

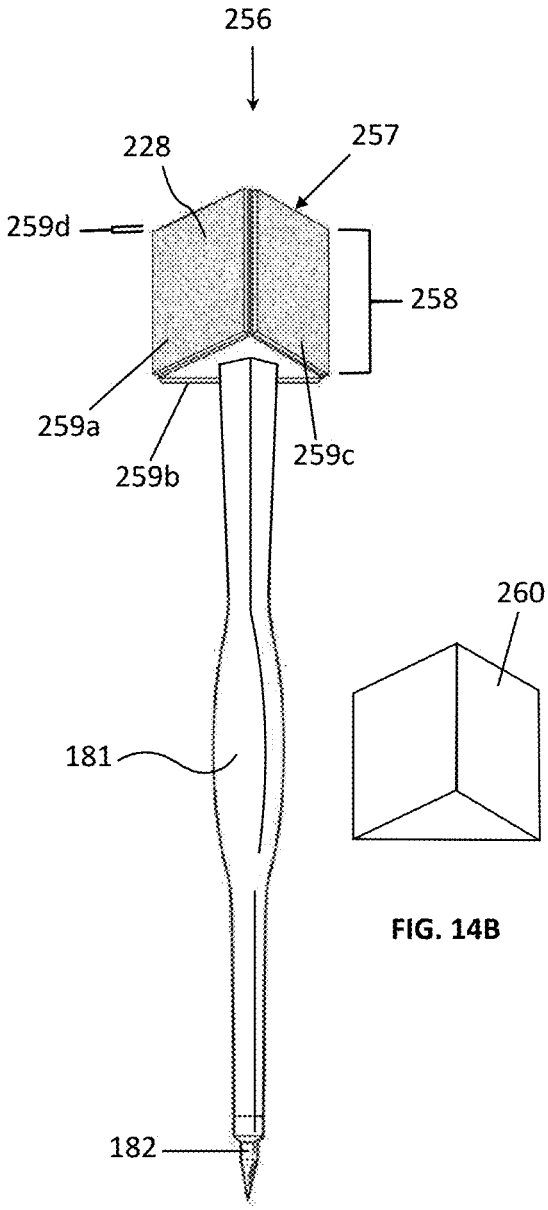
FIG. 14B
FIG. 14A
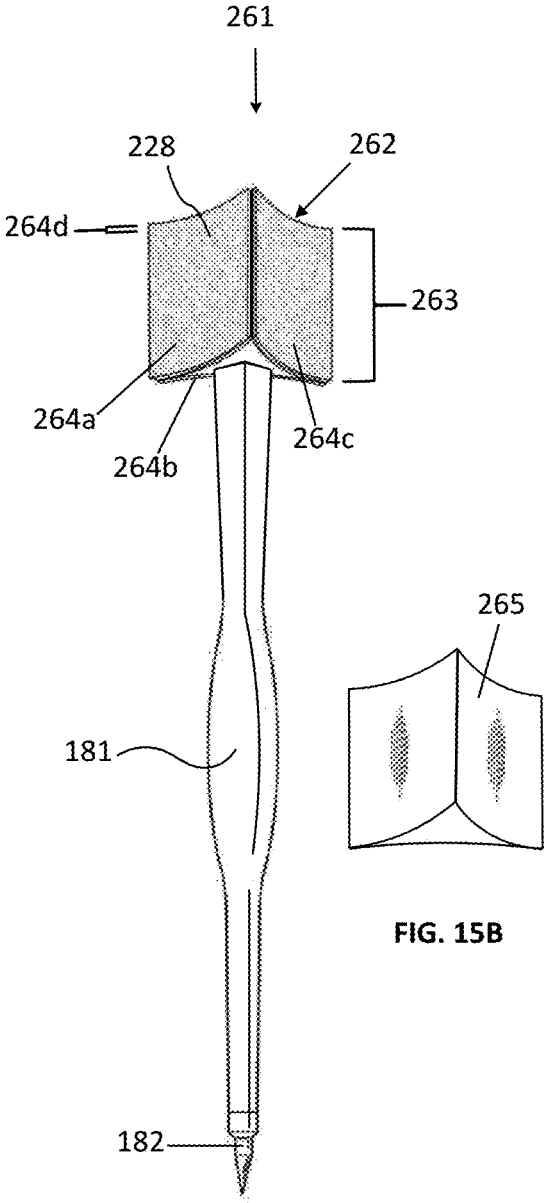
FIG. 15B
FIG. 15A

TOOLS FOR REMOVING NAIL POLISH AND BUFFING NAILS

CROSS REFERENCE TO RELATED APPLICATIONS

This application is a divisional application of the U.S. patent application Ser. No. 16/282,228, filed on Feb. 21, 2019, which claims the benefit of priority of U.S. provisional application No. 62/633,524, filed on Feb. 21, 2018, the contents of which are herein incorporated by reference in its entirety.

TECHNICAL FIELD

This invention relates to nail care devices and systems. More specifically, it relates to a nail care tool comprising an ergonomic handle, a replaceable head, and an end tip, which allows a person to conveniently remove nail polish, buff nails and clean around nails.

BACKGROUND

Nail care is an essential part in the maintenance of personal hygiene. In order to maintain healthy nails, individuals must keep their fingernails and toenails well-groomed at all times. The common practices of enhancing the appearance of nails comprise removing old or damaged nail polish, buffing, and cleaning around nails.

Modern nail polish has been on the nail care market for almost 100 years. Many individuals today, mostly women, beautify their fingernails and toenails by applying nail polish themselves or going to a professional nail technician to have them done. With an array of different nail polish types, colors and finishes to choose from, there seems to be no limit to how a person wears their nails. Nail lacquer, also known as regular nail polish, and no lamp long-lasting polishes are among the most commonly used nail polishes. Regular nail polish basically consists of film-forming agents, resins, solvents and pigments. No lamp long-lasting polishes provide users a hybrid of nail lacquer and gel.

A pristine nail manicure or pedicure can be achieved with a correct application of thin, even layers of base coat, nail polish and topcoat. However, even if the nail polish is applied with the proper procedure, most people constantly change it, completely or selectively, mainly due to chipping or smudging of the polish, grow out or an outfit change. This removal always involves cleaning off the existing polish by applying commercially available solvents in the form of nail polish removers.

When it comes to removing regular nail polish, no lamp long-lasting polishes or the like, the process usually becomes laborious, quite messy and time consuming, principally when removing darker and glitter-based polishes. Current commonly used methods employed to perform this removal task typically comprise applying nail polish remover onto a polished nail, with the use of a cotton ball, cotton round, nail polish remover pad or wipe, sponge, tissue or similar tool. Some of these tools need to be initially soaked in nail polish remover solution, and some already come pre-soaked with the fluid. In either case, the subsequent steps of holding the sodden tool with the fingers of one hand and rubbing it over the surface of a nail in the other hand in order to remove the nail polish therefrom, will inevitably and undesirably expose the user's fingers and fingernails to come into contact with a potentially hazardous enamel solvent and to get stained with dissolved polish. This occurs especially when the user desires to remove the polish entirely from all their nails, since this ordinarily requires rubbing repeatedly with the use of many units of the tool. If the person only wants to fix a damaged nail, it is almost inevitable that previously applied nail polish on their fingernails will end up smudged, marred or removed. Likewise, when a person uses their hands to remove old polish from their toenails, which for many are difficult to reach, their fingernails with previously applied nail polish are usually damaged.

The enamel solvent exposure problem is greatly compounded for many professional nail technicians that use those conventional tools daily, mostly cotton balls, to remove nail polish from their client's nails, often many times per day. While performing the removal, these nail techs commonly hold the saturated tool with their bare fingers. Thus, among the day-to-day challenges that numerous nail technicians confront, due to solvent exposure through skin or fingernail contact, is taking care of the appearance of their own fingernails when applying polish remover to others. It is also a challenge to reduce coming into contact with hazardous chemicals found in numerous polish removers, such as Acetone, Butyl Acetate and Ethyl Acetate, which can have health effects, including skin disorders. In this respect, contact dermatitis, also known as eczema, is the most common skin disorder encountered by nail technicians. Although wearing disposable gloves could minimize such exposure, doing so limits manual dexterity and might get very uncomfortable. At the same time, wearing them frequently and repeatedly may cause red, dry, itchy, irritated areas or blisters on the hands and wrists.

Further, those above-mentioned soft and bendable tools are not capable of holding a firm shape when in use, thus complicating the removal of polish from the nail edges and alongside the cuticle area. It also provokes the generation of irregular friction during cleaning mainly due to the shape variation in the area of contact of the tool when pressed over the nail surface, which is normally curved transversely. Less uniform friction forces between the soaked tool and the nail surface means it is harder to remove the polish.

In addition to those conventional tools, other types of nail polish removing devices have been proposed over the years. Various devices exist for removing nail polish comprising a handle portion in combination with an absorbent material component. Illustrative of this approach are disclosed in the following patent documents: Luscri U.S. Pat. No. 2,442,051 (May 1948); Johnson U.S. Pat. No. 2,713,693 (July 1955); Oliver U.S. Pat. No. 2,841,809 (July 1958); Winthrop U.S. Pat. No. 4,627,758 (December 1986); Smith et al. U.S. Pat. No. 4,884,913 (December 1989); Antonopoulos-McIvor U.S. Pat. No. 6,035,859 (March 2000); Dockery U.S. Pat. No. 6,405,735 B1 (June 2002); Crosby U.S. Pat. No. 6,575,172 B1 (June 2003); Thomas et al. U.S. Pat. No. 6,786,667 B1 (September 2004); Knapp et al. Pub. No. US 2008/0142405 A1 (June 2008); Wang Pub. No. US 2009/0090376 A1 (April 2009) and Dockery Pub. No. US 2014/0133895 A1 (May 2014).

Dipping jar-based systems is another general category of existing means to remove nail polish. The jar typically contains a sponge-like filler heavily soaked in nail polish remover. The filler is provided with a centered vertical opening into which the finger is inserted. Upon insertion of the fingertip into the aperture of the filler, the person must repeatedly twist and turn the polished nail against the filler until all the polish has been removed. For many people, this system requires skilled manual dexterity and is impractical to remove toenail polish. Because the fingertip is inserted inside the filler during cleaning, the person cannot see the nail when the polish is been removed. It usually takes extra effort to remove nail polish completely from the nail edges and alongside the cuticle area. Worse still, in the removal process, the finger is undesirably soaked in a mixture of potentially hazardous solvent and dissolved nail polish. Descriptive of this system are disclosed in the following patent documents: Scherer U.S. Pat. No. 4,440,181 (April 1984); Montiel U.S. Pat. No. 4,446,965 (May 1984); Montiel U.S. Pat. No. 4,530,726 (July 1985); Spector U.S. Pat. No. 4,671,306 (June 1987) and Barclay U.S. Pat. No. 7,225,814 B2 (June 2007).

In addition, U.S. Pat. No. 8,584,683 B2 (November 2013), issued in the name of Shammami, describes a disposable nail polish removing device whose body shape is generally spherical with one or more indentations. These indentations can be used to grasp the device while the remaining surface of the device can be used for nail cleaning purposes. The body of this apparatus is made solely of an absorbent material that compresses during use and resiliently returns to its original shape. This device does not have a handle component. As with the aforementioned traditional tools, to carry out the removal, the user has to hold the sodden apparatus with the fingers of one hand and rub it over the surface of the polished nail, thus inevitably exposing their fingers to come into contact with enamel solvent and to stain with dissolved polish.

Thus, the nail industry needs an improved nail polish removing device that overcomes the identified limitations and difficulties inherent in using the existing tools. It would be beneficial to provide an easy to grasp nail polish remover tool with a handle that allows a more efficient and safer procedure for individual and professional removal of regular nail polish, no lamp long-lasting polishes or the like, from fingernails and toenails.

On the other hand, nail buffing is an essential technique to help give nails a smooth, polished appearance by removing ridges, roughness, jagged nail edges and surface stains. The technique involves abrading, smoothing and polishing the nail using files or nail buffers of successively finer grit. During the past decades, a variety of abrasive tools have been used by individuals and nail technicians to employ this technique, including flat planar files and nail buffer blocks. Particularly, manual nail buffers include rectangular buffer blocks with various operational surfaces, each having an abrasive material or a polishing material, and at least two opposite ends. Illustrative of this kind of tool are disclosed in the following patent documents: Hokama U.S. Pat. No. 4,366,828 (January 1983); Letherby et al. U.S. Pat. No. 5,899,210 (May 1999) and Jancik Pub. No. US 2005/0081870 A1 (April 2005); Kim Pub. No. US 2006/0054177 A1 (March 2006) and Park U.S. Pat. No. D666,772 S (September 2012).

Although functional, traditional nail buffer blocks do not have a handle component or section, which constitutes a grip shortcoming or limitation. In order to operate it, the user must grasp the tool from its ends or in areas of the operational surfaces having abrasive material, with the bulky block itself in between their fingers. Thus, making it troublesome to hold and manipulate the nail buffer block at angles needed to achieve optimum results. During the buffing process, the user has to reposition frequently the nail buffer block in between their fingers, which may lead to grip discomfort. In addition, the skin of the user's fingers, primordially nail technicians, is susceptible to abrasion caused by coming into contact with the abrasive surfaces of the nail buffer block during periods of extended use.

An attempt to overcome this deficiency in the art is disclosed in the U.S. Pat. No. Des. 369,438 (April 1996), issued in the name of Resler, for a nail file ornamental design. This is the design of the commercially available nail buffer block entitled "Block On! Buffing Sponge Wand" from the brand Flowery. This device was formed with a rectangular, elongated block, made of sponge material that provides for four planar surfaces and two opposite ends. Each planar surface has adhered a treatment surface with an abrasive or buffing material, which is disposed on an intermediate foam layer. The treatment surfaces have different grit and are evenly sized. One of the short sides of all its treatment surfaces coincides in one end of the nail buffer block. The remaining portions of the treatment surfaces extend horizontally within the dimensions of the planar surfaces until they reach about two thirds of the length of the block. The areas of the planar surfaces not covered with the treatment surfaces, on the whole, is the handle portion of the tool, which contains four sharp longitudinal corners. This handle section is located on the opposite end to the one where the short sides of all the treatment surfaces coincide.

While the Resler device does provide a useful buffing tool, its handle section, however, has its limitations. Particularly, it does not have an ergonomic design. The grip is not contoured to the curve of the palm of the hand. This shortcoming results in an uncomfortable fit or grip, reduced grip strength and stability, less stroke power, decreasing productivity and hand fatigue.

Accordingly, the nail industry needs a multi-surfaced nail buffing tool with an ergonomic handle that comfortably fits the palm of the hand. It would be advantageous to provide an easy to grasp nail buffing tool with a handle that allows the user to conveniently hold and manipulate the tool for maximum efficiency in abrading, smoothing and polishing fingernails and toenails.

An exhaustive worldwide web search of existing nail care devices and systems did not disclose any patent document that read directly on the claims of the instant invention. Therefore, there is a need for a nail care tool that overcomes the identified limitations and difficulties inherent in using the existing devices, permitting more efficient, safe, precise, and tidy procedures for removing nail polish and buffing nails.

INVENTION OBJECTIVES

Therefore, it is a primary object of the present invention to provide a novel and versatile nail care tool useful in the removal of nail polish, in buffing nails, and cleaning areas around nails. Said tool comprises an ergonomic handle, a head section provided with an operational material, a scraping or cleaning end tip and a male/female connecting system or mechanism suitable to connect the handle section to the head section in a nonpermanent manner. In some embodiments, the operational material on the external surface of the head section is an absorbing material, suitable to remove nail polish, herein refers to as an applicator head. In other embodiments, the operational material is an abrasive material, conveniently used in the nail buffing process, said embodiments are refers in this application as buffer head. The scraping or cleaning end tip may be conveniently used in cleaning areas around nails.

More particularly, a main object of the present invention is to provide a nail care tool having an ergonomic elongated handle that will prevent the sodden applicator head or the nail buffer head from contacting the fingers been used to hold the tool by the handle during the removal or buffing process. The handle will also give the user greater reach when removing polish from their toenails or buffing them.

It is another object of the present invention to provide a nail care tool comprising a firm applicator head, capable of retaining toughness and shape when in use, and a scraping or cleaning end tip that allows a precise enamel removal from a polished nail with minimal solvent exposure to the skin around the nail. In yet another object of the present invention is to provide a nail care tool comprising a contoured firm applicator head with operational sections shaped to fit or receive a nail's convex surface.

It is another object of the present invention to provide a nail care tool comprising a nail buffer head with an ergonomic elongated handle that allows the user to conveniently hold and manipulate the tool.

Additional objects of the present invention reside in the provision of a novel nail care tool simple in form and construction, with an attractive appearance, inexpensive to manufacture and efficient in use.

BRIEF SUMMARY

The present invention fulfills the above and other objects, including those that will become apparent below, by providing a novel nail care tool comprising an ergonomic elongated handle, a head, and a scraping or cleaning end tip. The embodiments within the scope of the instant invention comprise a male-connecting unit and a female-connecting unit constituting a suitable male-female connecting system or mechanism, that allows the connection of the head section to the handle section in a non-permanent manner. Thus, allowing also the disconnection of the head section from the handle section of the tool.

Even though the drawings illustrate a threaded male-connecting unit and a threaded female-connecting unit, the scope of the invention embraces any other non-threaded suitable male/female connecting system or mechanism that allows the head and handle sections to be connected and disconnected or connected in a nonpermanent manner.

The ergonomic elongated handle described herein is used in all the embodiments, adding versatility to the invention. It comprises a hard and continuous elongated body comprising an external configuration having a first cylindrical elongated section having a free end, a second cylindrical elongated section having a wider diameter than the first cylindrical elongated section, and following the first cylindrical section, and a third elongated section, having four identical rectangular sides following the second cylindrical section and ending with a flat square end. The general external contour of the external configuration of the handle provides an ergonomic shape that facilitates gripping, maneuvering, and prolonged use without causing excess stress in the user's hand. The second and wider cylindrical section is suitably adapted to the length and curvature of the hand, providing relaxation to the user. Similarly, said handle also comprises an elongated solid body extension protruding outwardly from the center of the square flat end, which provides a male connecting unit to the head section, as discussed below.

Said handle also comprises a single internal cavity at the free end of the first cylindrical section, which is projected inwardly into said first cylindrical section. This small cavity has a single exit outwardly oriented to the free end of the first cylindrical body and in the opposite position of the male-connecting unit. Except for this cavity, the handle's internal body has no other exit from the interior of its body. Thus, the elongated body of the handle comprises a first end, which is the free end of the first cylindrical elongated section, and a second end at the opposite side of said first end, which is the body or extension protruding from the end of the square section.

The invention also comprises a scraper or cleaning end tip, which is a small stick made of any solid, hard, and firm material such as wood, plastic, or other material, strong enough to maintain its structure while being pushed and pulled inside the peripheral areas of a fingernail or toenail to remove small particles, usually dirt or the like, from the cuticle areas or the distal edge of the fingernail or toenail. It comprises a nonthreaded cylindrical body with a first pointy end and a second diagonal end. The scraper is inserted in the interior of the small non-threaded cylindrical cavity of the first cylindrical section. Since said cylindrical cavity is sized to receive only nearly half of the scraper length, once inserted in said cavity, one end of the scraper remains enclosed inside the handle. In contrast, the other end of the scraper remains free for use. Similarly, since the rest of the handle is solid and hard, the end of the enclosed scraper in the cavity's interior resists the pressure exerted during the scraping, and it cannot sink into the interior of the handle. Similarly, grabbing and pulling the free end of the scraper easily removes it from the handle. In this manner, the user may select to their convenience the use of the first pointy end or second diagonal end of the scraper by merely selecting which end is inserted into the handle or by simply removing or detaching it from the handle and reinserting it in a predetermined position.

The herein disclosed head is the main operational section of the tool. Said head comprises a main body, said main body comprising a bottom section having a flat configuration; a lateral section, formed by sides extending upwardly from the edges of the bottom section, and having an external surface and an internal surface; a top section having an external surface and an internal surface that encloses the edges of the sides of the lateral section, creating said main body. The lateral section, as the top section of the head, is continuous, meaning they do not have any openings or apertures from or to the interior of the head. The bottom section, however, has a single female-connecting unit with an internal cavity projected inwardly into the interior of the main body of the head and a single exit outwardly oriented toward the base section. Since the interior of the body of the head is solid, the said cavity provides a single exterior opening designed to cooperatively receive the protruding extension on the square section of the handle, thus constituting a suitable male-female connecting system or mechanism that allows the connection of the head section to the handle section in a non-permanent manner; therefore, also quickly allowing the connection/disconnection of the head and the handle. Thus, said head may have different geometrical shapes having the exterior surface of at least the lateral section covered, with an operational lining material, herein defined as a suitable material used normally in the care and maintenance of nails. In some instances, the said material is an absorbent material, thus providing a nail polish removal tool or a polish remover applicator. As expected, the use of said nail polish remover applicator requires the proper soaking of the operational absorbing material in an external source of solvent or nail polish dissolvent without the user being in direct contact with such substance. It also facilitates the removal of nail polish from fingernails and toenails with little or no contact of the user with the solvent or the already dissolved nail polish and solvent messy mixture. In other instances, the operational material is an abrasive material, thus providing a nail buffing tool or simply named "nail buffer".

In some embodiments, the user may conveniently change the operational lining material of the head once it has been already used and replace it with a new one.

BRIEF DESCRIPTION OF THE DRAWINGS

The foregoing and additional features and characteristics of the embodiments of the present invention will become more apparent from the following detailed description considered with reference to the accompanying drawings, which are used herein in a manner of example only, and wherein:

FIGS. 9A and 9B illustrate perspective views of an embodiment according to the invention, comprising a head with a lateral section having three concave lateral sides and its corresponding head cap, respectively, and wherein the external surface of the lateral and top sections of the head comprises a lining of absorbing material useful in the removal of nail polish, defined as a nail polish remover applicator in the instant application.

FIG. 9C is a top view of the head section of the embodiment shown in FIG. 9A, which comprises a top section with three sides pyramidal shape.

FIGS. 10A and 10B illustrate perspective views of an embodiment according to the invention, comprising a head with with a lateral section having three straight lateral sides and its corresponding head cap, respectively, and wherein the external surface of the lateral section and the top section of the head comprises a lining of absorbing material useful in the removal of nail polish, defined as a nail polish remover applicator in the instant application.

FIG. 10C illustrates a top view of the head section of the embodiment illustrated in FIG. 10A, which has a three-sided pyramidal shape top section.

FIGS. 12A and 12B illustrate perspective views of an embodiment of a nail buffing tool, according to the invention, comprising a head with a lateral section having four straight lateral sides and a flat top section, with four straight lateral sides and a flat top, and its corresponding head cap, respectively.

FIGS. 13A and 13B illustrate perspective views of an embodiment according to the invention, comprising a head with a lateral section having four concave lateral sides and flat top section, and its corresponding head cap, respectively, and wherein the external surface of the lateral section of the head comprises a lining of abrasive material useful in buffing nails, thus providing a nail buffing tool.

FIGS. 14A and 14B illustrate perspective views of an embodiment according to the invention, comprising a head with a lateral section having three straight lateral sides and a flat top section, and its corresponding head cap, respectively, and wherein the external surface of the head comprises a lining of abrasive material useful in buffing nails, thus providing a nail buffing tool.

FIGS. 15A and 15B illustrate perspective views of an embodiment according to the invention, comprising a head with a lateral section having three concave lateral sides and its corresponding head cap, respectively, and wherein the external surface of the lateral section of the head comprises a lining of abrasive material useful in buffing nails, thus providing a nail buffing tool.

in FIG. 16, an embodiment of the invention is shown being used in the removal of nail polish after the absorbent material covering the lateral and top section of the head has been soaked in solvent from an external solvent source; in FIG. 17, an embodiment of the invention is illustrated in use as a nail buffing tool; and in FIG. 18, is illustrated the used of the scraper tip in cleaning cuticle areas and pushing cuticle and surrounding areas.

DETAILED DESCRIPTION OF THE EMBODIMENTS

Figure 1A:
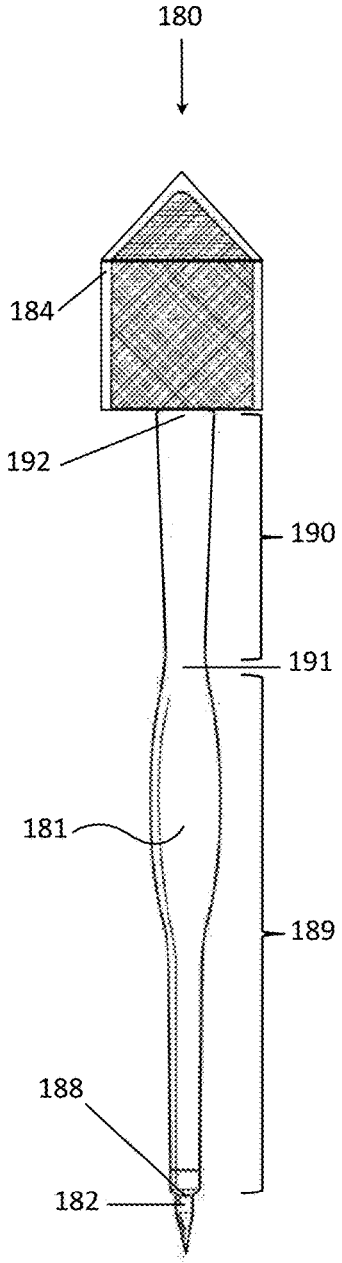
FIG. 1A shows a front view of a given embodiment according to the invention, having its corresponding head cap on, wherein the different components of the tool are assembled, and wherein the external surface of the lateral and top sections of the head section comprises an operational lining of absorbing material useful in removing nail polish, defined as a nail polish remover applicator in the instant application.

Detailed embodiments of the present invention are disclosed herein; however, it is to be understood that the disclosed embodiments are merely exemplary of the invention that may be embodied in various and alternative forms.

It is thus to be understood that this invention is not limited to particularly exemplified structures, components, methods, or uses, as such may, of course, vary. The drawings are not necessarily to scale; some features may be exaggerated or minimized to show details of particular components. It is also to be understood that the terminology used herein is for the purpose of describing particular embodiments of the invention only and is not intended to limit the scope of the invention in any manner. It must be noted that, as used in this specification and the appended claims, the singular forms "a." "an," and "the" include plural referents unless the content clearly dictates otherwise. Therefore, specific structural and functional details disclosed herein are not to be interpreted as limiting, but merely as a representative basis for the claims and/or as a representative basis for teaching one skilled in the art to variously employ the present invention.

In general terms, a series of embodiments according to the instant invention are herein disclosed. All embodiments comprise an ergonomic elongated handle, a scraper, a head section, and a male/female connecting system or mechanism suitable for connecting and disconnecting the head section from the handle. Head caps simulating the external geometry of each described head section are also disclosed.

The head section comprises a main body, said main body comprising a bottom section having a flat configuration; a lateral section, formed by sides extending upwardly from the edges of the bottom section, and having an external surface and an internal surface; a top section having an external surface and an internal surface which edges converge with the edges of the sides of the lateral section, creating said main body. The lateral section, as the top section of the head, is continuous, meaning they do not have any openings or apertures from or to the interior of the head. The bottom section, however, has a single female-connecting unit with an internal cavity projected inwardly into the interior of the main body of the head and a single exit outwardly oriented toward the bottom section. Said exit is the only exterior opening on the entire main body of the head section.

The head section may have different geometrical shapes, and all of the said head sections include an "operational material" fixed on the external surface of the lateral and/or the top sections of the head. As previously defined, it is a suitable material customarily used in nail polish removal or nail buffing. Any embodiments herein described wherein the operational material is an absorbent material, are called throughout this application a "nail polish remover applicator" or "nail polish removal tool", while those embodiments having as the operational material an abrasive material are herein named as "nail buffer" or "nail buffing tool". Therefore, said operational material defines the particular function of a given embodiment of the tool according to the invention, and it may be fixed, secured, attached, or adhered on the external surface of the lateral and/or top sections of the head of the tool by means of any suitable and convenient method known in the art, with the intention to cover said external surface in such a manner that said operational material remains fixed or attached to said external surface.

In regard to the ergonomic elongated handle described herein, it is used in all the embodiments, adding versatility to the invention. It comprises a hard and continuous elongated integral body comprising an external configuration having a first cylindrical elongated section having a free end, a second cylindrical elongated section having a wider diameter than the first cylindrical elongated section, following the first cylindrical section, and a third elongated section, having four identical rectangular sides following the second cylindrical section and ending with a flat square end. The general external contour of the handle provides an ergonomic shape that facilitates gripping, maneuvering, and prolonged use without causing excess stress in the user's hand. The second and wider cylindrical section is suitably adapted to the length and curvature of the hand, providing relaxation to the user.

Similarly, said handle also comprises an elongated solid body extension protruding outwardly from the center of the square flat end. This provides a male-connecting unit designed to cooperatively be received into the single female-connecting unit formed by the internal cavity projected inwardly into the interior of the head's main body via the single exit outwardly oriented toward the bottom section of the head. Thus, said male-female connection system constitutes a suitable male-female connecting system or mechanism that allows the connection of the head section to the handle section in a non-permanent manner, therefore also quickly allowing the connection/disconnection of the head and the handle.

It also comprises a single internal cavity at the free end of the first cylindrical section, which is projected inwardly into said first cylindrical section. This small cavity has a single exit outwardly oriented to the free end of the first cylindrical body and in the opposite position of the male-connecting unit. With the exception of this cavity, the handle's internal body has no other exit or opening.

Regarding the cleaning end tip or scraper, it is a small stick made of any solid, hard, and firm material such as wood, plastic, or other material, strong enough to maintain its structure while being pushed and pulled inside the peripheral areas of a fingernail or toenail to remove small particles, usually dirt or the like, from the cuticle areas or the distal edge of the fingernail or toenail. It comprises a nonthreaded cylindrical body with a first pointy end and a second diagonal end. The scraper is inserted in the interior of the small cylindrical cavity at the free endo of the first cylindrical section of the handle. Since said cylindrical cavity is sized to receive only nearly half of the scraper length, once inserted in said cavity, one end of the scraper remains enclosed inside the handle. In contrast, the other end of the scraper remains free for use. Similarly, since the rest of the handle is solid and hard, the end of the enclosed scraper in the cavity's interior resists the pressure exerted during the scraping, and it cannot sink into the interior of the handle. Similarly, grabbing and pulling the free end of the scraper easily removes it from the handle. In this manner, the user may select to their convenience the use of the first pointy end or second diagonal end of the scraper by merely selecting which end is inserted into the handle or by simply removing or detaching it from the handle and reinserting it in a predetermined position.

Figure 1B:
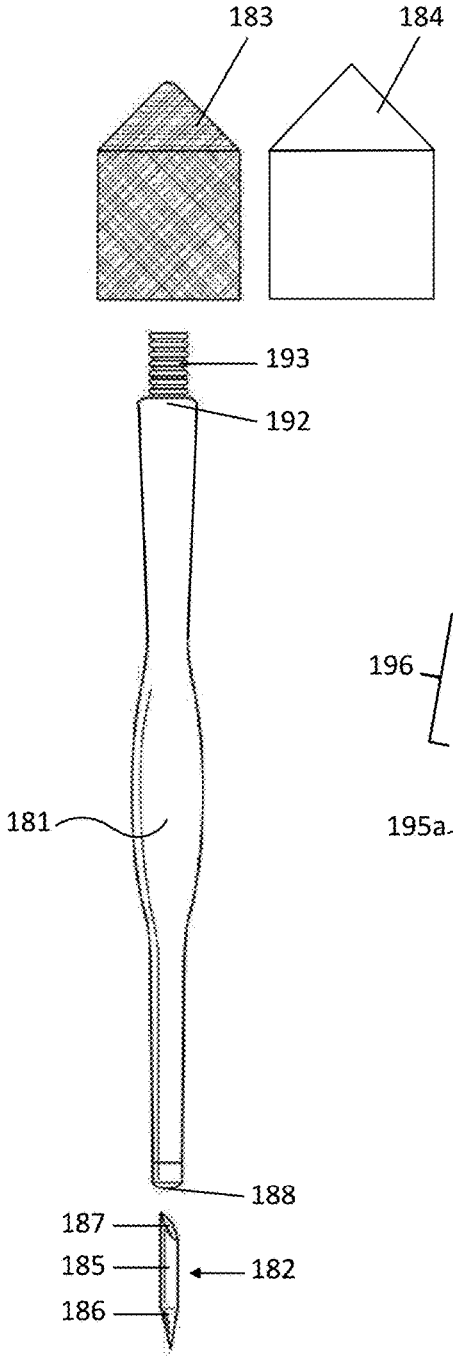
FIG. 1B illustrates the embodiment shown in FIG. 1A, wherein the different components of the tool are separated into their components.

In particular, and in reference to the drawings, FIGS. 1A and 1B illustrate embodiment 180 of the invention. FIG. 1A illustrates embodiment 180, which is already assembled, while FIG. 1B shows individual parts of embodiment 180. It comprises an elongated ergonomic handle 181, scraper 182, head 183, and head cap 184. Embodiment 180 also comprises a male/female connecting system or mechanism in order to connect or disconnect head 183 to or from handle 181, respectively. In some embodiments, such a mechanism comprises a threaded male connecting unit and a female threaded connecting unit that may be connected or disconnected by simply fastening or unfastening the head 183 to or from handle 181. Such a system may be substituted by any other suitable connecting system that allows the non-permanent connection of head 183 to handle 181.

Figure 3:
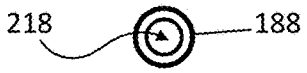
FIG. 3 illustrates the top bottom view of the free end of the first cylindrical section and the single exit of the internal cavity on said free end of the first cylindrical section of the handle illustrated in FIG. 1B.
Figure 4:
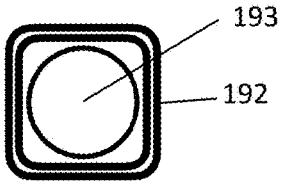
FIG. 4 illustrates the top view of the flat square end of the third elongated section, of the handle illustrated in FIG. 1B, having at its center the top view of the extension protruding from said flat square end at the handle.
Figure 5:
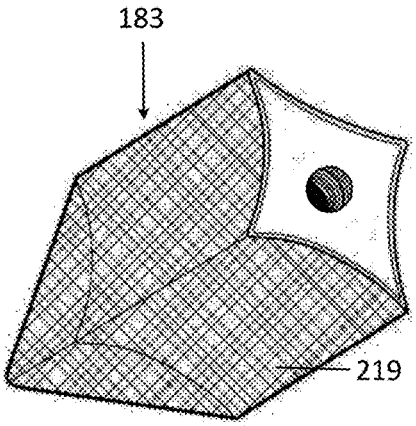
FIG. 5 illustrates the head section of the embodiment shown in FIG. 2A with a sheath lining of an absorbent material fixed to the exterior surface of its lateral and top sections.

The ergonomic design of the handle 181 provides a suitable configuration or shape where the User may place and accommodate his or her hand and fingers, thus allowing the relaxation of the hand muscles. As shown in FIG. 1A, elongated ergonomic handle 181 comprises a first cylindrical section, and a second cylindrical section, having a wider diameter than the first section. Both sections are identified with the numeral 189, followed by the second cylindrical section, a third elongated section 190, having four identical rectangular sides and ending with a flat square end 192, as illustrated in FIG. 4. Numeral 189 shows the first and second cylindrical sections of the handle, which starts at the free end 188 of the first cylindrical section of the handle 181 and constantly increases in diameter to render the second cylindrical section to further decrease said diameter up to position 191, wherein there is a transition in geometry from a cylindrical shape or configuration to a rectangular shape, thus providing a third elongated section 190, which has four identical rectangular sides, which concludes as a flat square end 192 of the handle 181. At the free end 188 of the first cylindrical section, there is a cylindrical cavity 218, shown in the bottom view of the handle in FIG. 3, which is the only internal cavity of the handle. Said cavity 218 is projected inwardly into said first cylindrical section, wherein is enclosed, and it has a single exit outwardly oriented to the free end of the first cylindrical section 188. With the exception of this cavity, the handle's internal body has no other opening or exit from its interior. At the center of the flat square end 192 of the elongated third elongated section 190, handle 181 comprises an elongated male connector section 193, which is positioned opposite the cylindrical cavity unit 188, as shown in FIGS. 1B and 4. Elongated ergonomic handle 181 may be made of any suitable rigid, durable material such as molded plastic, resin, metal, or plastic; more preferably, resin or plastic.

Scraper 182 is a stick made of any solid and firm material, such as felt, wood, firm foam, plastic, or other suitable material. It comprises a cylindrical body 185 with a first pointy end 186 and a second diagonal end 187. Scraper 182 is inserted non-permanently into the nonthreaded cylindrical internal cavity 218, located at the first end 188 of the first cylindrical section of handle 181.

Figure 2A:
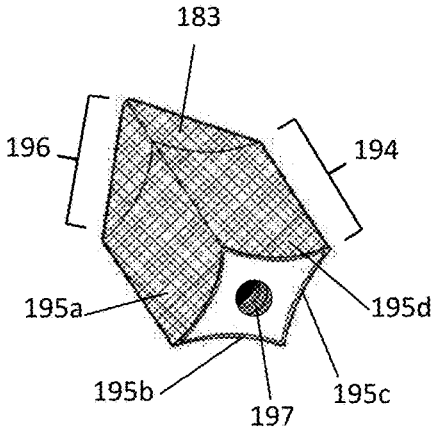
FIGS. 2A and 2B illustrate perspective and top views, respectively, of the head section of the embodiment illustrated in FIGS. 1A and 1B, said head comprising a lateral section with four concave lateral sides and a top section with four pyramidal sides.
Figure 2B:
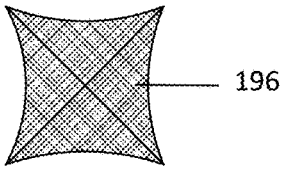

Head 183 is connected in a non-permanent manner to the second end 192 of handle 181. It is disposable or reusable. FIG. 2A illustrates a perspective view of head 183, while FIG. 2B illustrates its top view. It comprises a main body, with a lateral section 194, having a tridimensional rectangular configuration formed by curved or concave lateral sides 195*a*, 195*b*, 195*c*, and 195*d*, extending upwardly and continuously from the edges of the flat base section and wherein the edges of said lateral sides converge with the edges of top section 196, forming a four-sided pyramidal shape, as shown in FIG. 2A. The lateral section 194, as the top section 196 of the head183 do not have any openings or apertures from or to the interior of the main body of the head. The base section, however, has a single female-connecting unit 197 that comprises an internally threaded cavity at the center of the bottom section projecting inwardly into the interior of the main body of the head and having a single exit outwardly oriented toward the bottom section. The cavity provides a single exterior opening in the entire main body of the head section. Said internally threaded cavity is the only single threaded part of the head 183, and it constitutes the female connecting unit designed to cooperatively be adapted to the male connecting unit of handle 181, which is the elongated body extension 193, protruding outwardly from the center of the square flat end 192 of handle 181. Thus, in this embodiment 180, handle 181 may be connected to and may be disconnected from head 183 by means of inserting the male connecting threaded unit 193 on the female connecting unit or threaded opening 197 and fastening or unfastening it, respectively. According to the invention, such a male/female connecting system or mechanism may be substituted by any other suitable connecting system that allows the non-permanent connection of head 183 to the handle 181.

Figure 6:
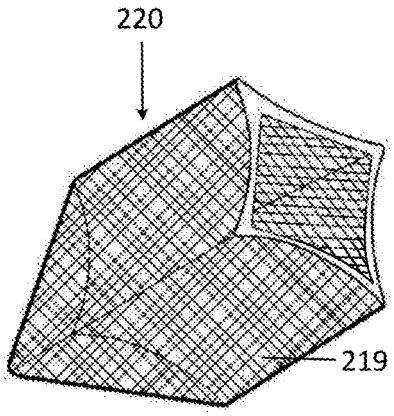
FIG. 6 illustrates a single unit sheath lining of an absorbent material, in a cap-like shape, ready to be fixed to the exterior surface of the lateral and top sections of the head as illustrated in FIGS. 2A and 5.

The external surface of the head 183 comprises operational material 219, made of a suitable material capable of absorbing and retaining fluids, such as felt, polyester, polypropylene, cotton, and sponge; preferably polyester or polypropylene felt. The operational material of the absorbent material is fixed to the external surface of the lateral section 194 and the top section 196 of the head 183 by means of any suitable covering methods known in the art. For instance, said absorbent material 219, alternatively, may be molded in a single unit or sheath layer 220, as the one illustrated in FIG. 6, which simulates the shape of the lateral section 194 and the top section 196 of the head 183 and which is further fixed on the external surface of said lateral section 194 and the top section 196 of the head 183. Such a single unit or sheath layer 220 may be suitably made by a heat molding process in a cap-like shape that simulates the shape of the lateral section 194 and the top section 196 of the head section 183.

Once prepared or molded, said sheath layer 220 may be fixed to the lateral section, and the top section of the head 183 by any suitable fixing means known in the art. Any of said fixing means may comprise substances resistant to acetone and similar solvents. Such means may include adhesives, such as hot-melt adhesive, glue, epoxy, double-sided adhesive, and thermal bonding.

Figure 7A:
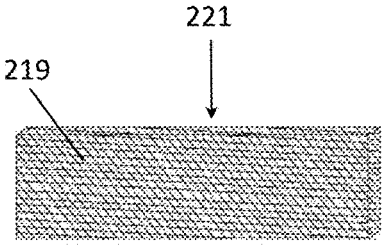
FIG. 7A illustrates a rectangular strip of an absorbent material, useful in an alternate process to fix said material to the lateral section of the head of the embodiment shown in FIG. 2A.
Figure 7B:
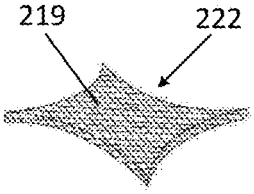
FIG. 7B illustrates a single unit of an absorbent material, useful in an alternate process for adhering said material to the top section of the head section of the embodiment illustrated in FIG. 2A.

The operational material 219, alternatively, may be fixed to the external surface of the lateral section of the head 183 by adhering a rectangular strip 221 of the selected absorbent material, illustrated in FIG. 7A, around the said lateral sides of head 183, thus covering the external surface of said lateral section 194 of head 183. Subsequently, top section 196 is covered by adhering to it a single piece 222 of the absorbent material, as the one illustrated in FIG. 7B.

Figure 8:
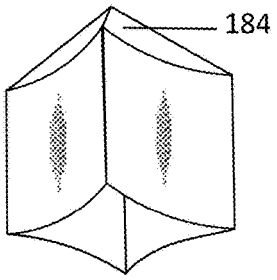
FIG. 8 illustrates the head cap of the head section shown in FIG. 1B, which is useful for protecting the head section once it is not in use.

FIG. 8 illustrates a tridimensional and perspective view of head cap 184. It may be made of plastic and simulate the external geometrical shape of the lateral and top sections of the head 183. This cap is intended to cover these sections and protect them when not in use.

FIG. 9A illustrates embodiment 199 of the invention. FIG. 9B illustrates the corresponding head cap 204 for embodiment 199, and FIG. 9C shows a top view of embodiment 199. Embodiment 199 comprises the same main external sections as embodiment 180: a head having an operational material of absorbent material 219 fixed on the external surface of lateral section 201 and top section 203, an elongated ergonomic handle, a male/female connecting/disconnecting system, a scraper, and a head cap. However, the head section 200 of embodiment 199 is different from the head section of embodiment 180 since it comprises a single unit body with lateral section 201 having an external geometrical tridimensional in triangular shape formed by curved or concave lateral sides 202*a*, 202*b* and 202*c*, that are extended continuously until converging into a three sides pyramidal shape top section 203, shown in the top view illustrated in FIG. 9C.

As mentioned previously, head cap 204 simulates the external geometrical shape of lateral section 201 and top section 203 of head 200. Similarly, FIG. 10A illustrates embodiment 205 of the invention, comprising the same main external sections of embodiment 180: a head having an operational material of absorbent material 219 fixed on the external surface of lateral section 207, and top section 209, an elongated ergonomic handle, a male/female connecting/disconnecting system, a scraper, and a head cap. However, the head section 206 of embodiment 205 is different from the head section of embodiment 180 since it comprises a single unit body with lateral section 207 having an external geometrical tridimensional in triangular shape formed by flat lateral sides 208*a*, 208*b* and 208*c* that are extended continuously until converging into a three-sided pyramidal shape top section 209, shown in FIG. 10C. Head cap 210 simulates the external shape of the lateral section 207 and top section 209 of head 206, as shown in FIG. 10B.

Figure 11A:
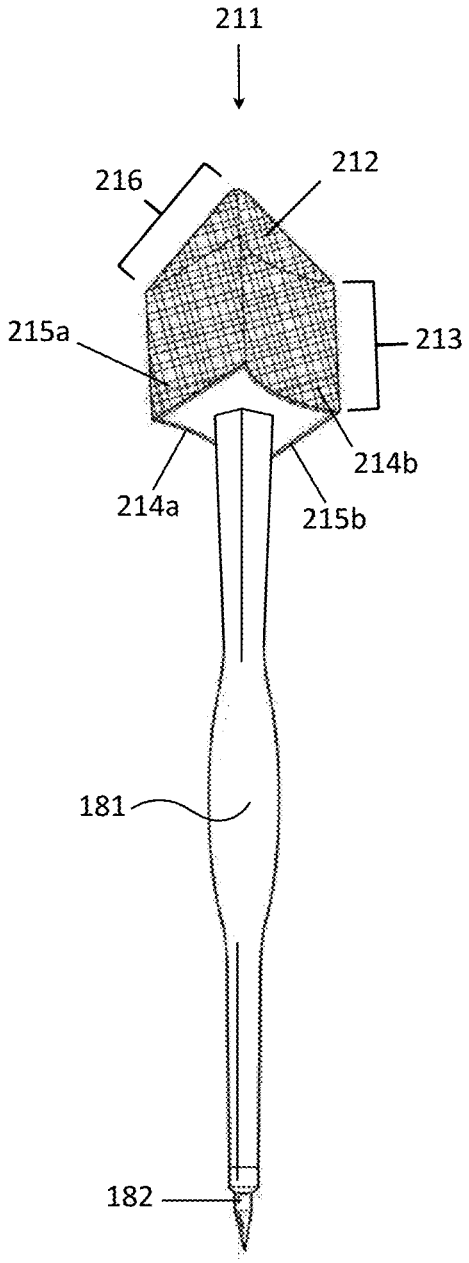
FIGS. 11A and 11B illustrate a perspective view of an embodiment according to the invention, comprising a head with a lateral section having two concave sides and two straight sides with two concave sides and two straight sides, and its corresponding head cap, respectively, and wherein the external surface of the lateral and top sections of the head comprises a lining of absorbing material useful in the removal of nail polish, defined as a nail polish remover applicator in the instant application.

Likewise, FIG. 11A illustrates embodiment 211 of the invention, comprising the same main external sections of embodiment 180: a head having an operational material of absorbent material 219 fixed on the external surface of lateral section 213, and top section 216, an elongated ergonomic handle, a male/female connecting/disconnecting system, a scraper, and a head cap.

Figure 11B:
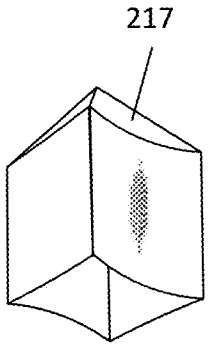
Figure 11C:
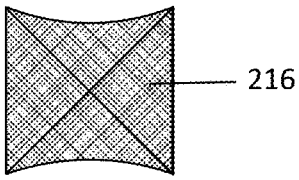
FIG. 11C illustrates a top view of the head section of the embodiment illustrated in FIG. 11A, which has a four sides pyramidal shape top section.

However, the head section 212 of embodiment 211 is different from the head section of embodiment 180 since it comprises a single unit body with lateral section 213 having an external geometrical tridimensional triangular shape formed by two curved or concave lateral sides, 214*a* and 214*b*, and two flat lateral sides, 215*a* and 215*b*, that are extended continuously until converging into a four sides pyramidal shape top section 216, shown in FIG. 11C. As illustrated in FIG. 11B, head cap 217 simulates the external shape of head 212.

The scope of this invention also comprises embodiments directed to tools useful in buffing nails, wherein, the operational material fixed on the external surface of the lateral section 249 of the head section 247 of the tool 244 is an abrasive material 228, in place of an absorbing material 219, thus providing a nail buffing tool or nail buffer. Said abrasive material 228 is fixed, attached, or adhered to the external surface of the lateral sides of the lateral section 249 of the head section 247 of the tool. The abrasive material 218 is commercially available in resilient strips, pads, sheets, or rolls format. Said resilient material may have one of its surfaces covered with an adhesive that is ready to be fixed, attached, or adhered to a suitable surface, while the opposite side comprises the buffing material. The resilient material is also commercially available, having both surfaces of the strip covered with buffing material. Said buffing material is available in a variety of coarse-grit abrasive layers, which have different degrees of roughness.

The abrasive material 228 material may be fixed securely on the lateral sides of the lateral section of the head section of the tool by any suitable bonding means, including but not limited to gluing, cementing, and bonding. These means include adhesives, such as hot-melt adhesive, glue, double-sided adhesive, and thermal bonding. In a preferred embodiment, a bonding medium, such as an adhesive, is employed to fix and secure each piece of abrasive material 228 to the lateral sides of the lateral section. Embodiments of the buffing tools within the scope of the invention comprise embodiments having the abrasive material fixed, adhered, or attached to all lateral sides of the lateral section of the head section having the same preselected coarse-grit or roughness. In other embodiments, the buffer tools have fixed, adhered, or attached preselected strips having different coarse-grits of roughness or a combination thereof on a given lateral sides of the head section. For instance, in a given embodiment having a head with four lateral sides, it may have fixed, adhered, or attached a resilient strip coated with a coarse-grit abrasive layer; other of the lateral sides may have fixed, adhered, or attached a resilient pad with a medium-grit abrasive layer, while another lateral side may have fixed, adhered, or attached a resilient pad coated with a fine-grit abrasive layer, while the remaining lateral side may have fixed, adhered, or attached to them a resilient material with an extra fine grit abrasive layer.

FIG. 12A illustrates embodiment 244, a nail buffing tool according to the instant invention. It comprises the same main external sections of embodiment 180: a head, an elongated ergonomic handle, a male/female connecting/disconnecting system, a scraper, and a head cap. However, the head section 247 of embodiment 244 is different from the head section of embodiment 180 since it comprises a single unit body with an external geometrical shape having a tridimensional rectangular lateral section 249 constituted by the flat lateral sides 250*a*, 250*b*, 250*c* and 250*d*, and a flat topside-top section 250*e*. As illustrated in FIG. 12B, head cap 248 simulates the external shape of head 247. In addition, said sides of the lateral and top sections of head 247 have fixed, adhered, or attached on its external surface a resilient strip or pad comprising a film of buffing material 228.

FIG. 13A illustrates embodiment 251 of the instant invention, which comprises the same main external sections of embodiment 244: a head having an operational material of buffing material 228 fixed on its external surface, an elongated ergonomic handle, a male/female connecting/disconnecting system, a scraper, and a head cap. However, in embodiment 251, head 252 comprises a single unit body with an external geometrical shape having a tridimensional rectangular lateral section 253, which is formed by the concave or curved lateral sides 254*a*, 254*b*, 254*c*, and 254*d*, and a flat top section 254*e*. Head cap 255, illustrated in FIG. 13B, simulates the external shape of the lateral and top sections of head 252.

FIG. 14A illustrates embodiment 256 of the instant invention, which comprises the same main external sections of embodiment 244: a head having fixed, adhered, or attached on the external surface of the lateral sections 258, a resilient strip or pad comprising a film of buffing material 228, an elongated ergonomic handle, a male/female connecting/disconnecting system, a scraper, and a head cap. Nonetheless, in embodiment 256, head 257 comprises a single unit body with an external geometrical shape having a tridimensional triangular lateral section 258, formed by the flat lateral sides 259*a*, 259*b*, and 259*c*, and a flat top section 259*d*. As illustrated in FIG. 14B, head cap 260 simulates the external shape of the lateral and top sections of head 257.

FIG. 15A illustrates embodiment 261 of the instant invention, which comprises the same main external sections of embodiment 244: a head having fixed, adhered, or attached on the external surface of the lateral section 263, a resilient strip or pad comprising a film of buffing material 228, an elongated ergonomic handle, a male/female connecting/disconnecting system, a scraper, and a head cap. However, in embodiment 261, head 262 comprises a single unit body with an external geometrical shape having a tridimensional triangular lateral section 263 formed by the concave or curved lateral sides 264*a*, 264*b*, and 264*c*, and a flat top section 264*d*. As shown in FIG. 15B, head cap 265 simulates the external shape of the lateral section and top section of head 262.

Figure 16:
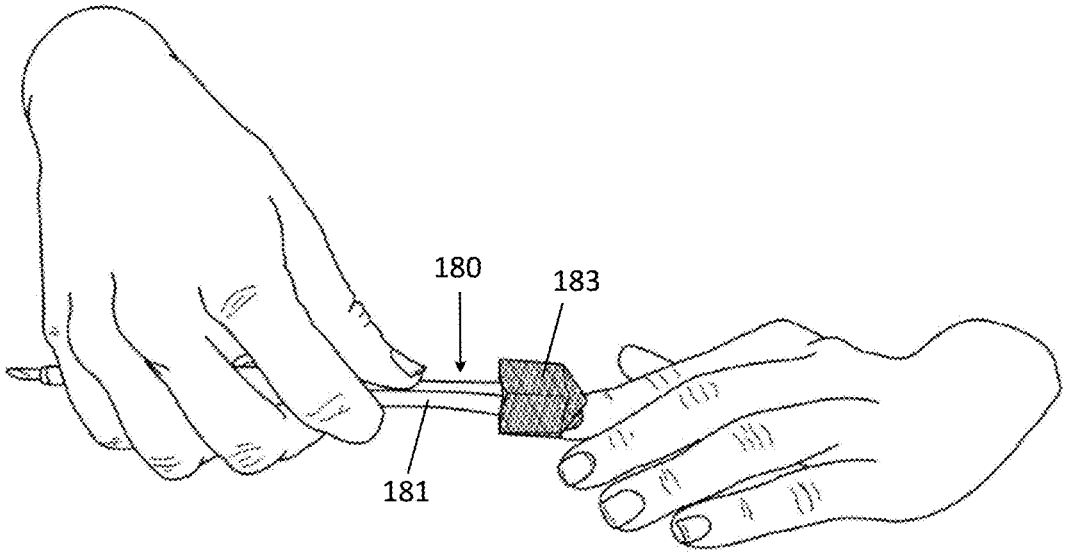
FIGS. 16 to 18 show different manners of using the tool according to the instant invention.

In operational terms, the use of the applicator tool 180 is illustrated in FIG. 16, wherein the User first grabs the handle 181 with one hand surrounding the second cylindrical section of the handle 181 and, after saturating the absorbent material 219, fixed, attached, or adhered to the head section of the nail polish removal tool 180 in an external solvent source, proceeds to rub the saturated section of the applicator head 183 over the nail polish to be removed on the nails of the opposite hand. This pressured rubbing action removes the nail polish therefrom. More specifically, the handle 181 is held with its second cylindrical section in the hand palm while the thumb of the user is resting on one of the rectangular faces of the third elongated section 190 of the handle, while one of the rectangular sides of the lateral section 194 of head 183 is being used to remove the nail polish from a nail.

Figure 17:
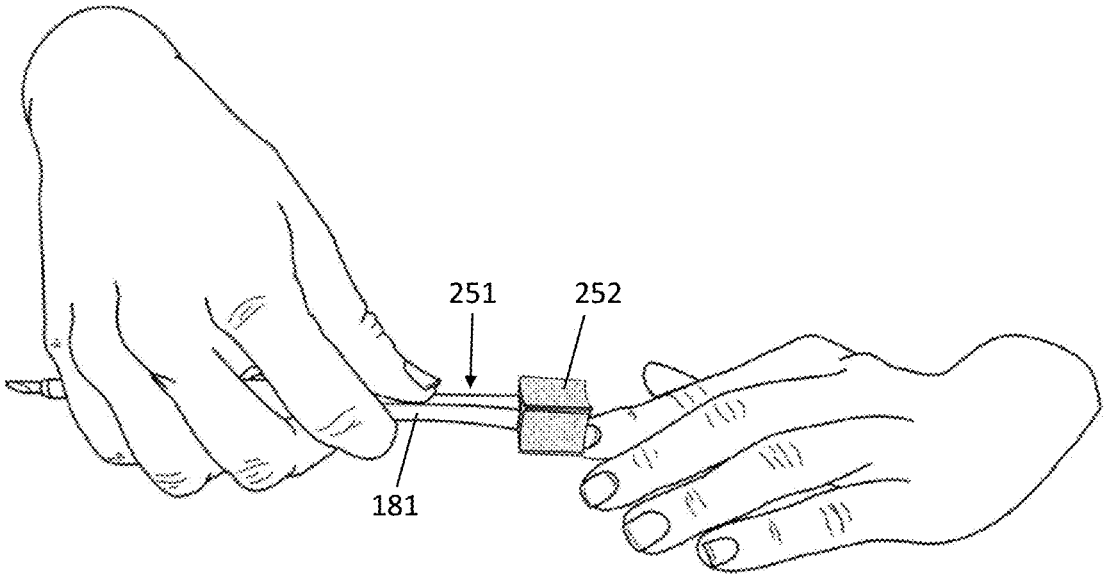

On the other hand, the use of the nail buffing tool 251, as herein disclosed, is illustrated in FIG. 17. As shown, the User grabs the handle 181 with one hand and buffs one of their nails with the other hand. As illustrated in FIG. 17, the nail buffing tool 251 is held with the second cylindrical section of the ergonomic elongated handle 181 resting inside the hand's palm while the thumb of the user is resting on the rectangular sides of section 190 and one of the lateral sides of the lateral section 253 of the head 252 is being used to buff a nail.

Figure 18:
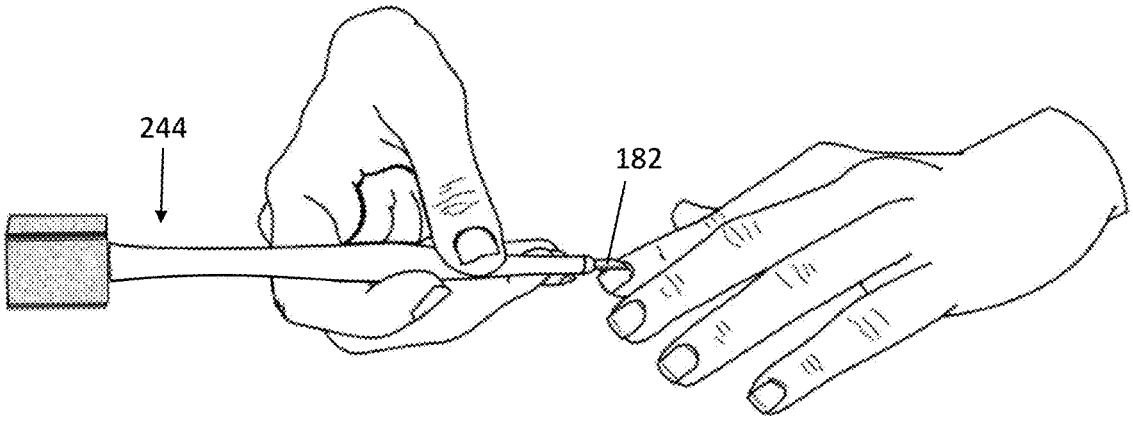

In FIG. 18, the use of scraper 182 is illustrated. The User is shown removing the remains of materials. The scraper 182 is useful for detailed nail cleaning, particularly around cuticle areas.

Finally, while the present invention has been described in terms of particular embodiments and applications, in both summarized and detailed forms, it will be understood that many substitutions, changes, and variations in the described embodiments, applications, and details of the novel tool illustrated herein and of its operation can be made by those skilled in the art to adapt it to various usages and conditions, without departing from the spirit of this invention. As such, these changes and modifications are properly, equitably, and intended to be within the full range of equivalence of the following. While the invention has been described in conjunction with some embodiments, it is to be understood that many alternatives, modifications, and variations will be apparent to those skilled in the art in light of the foregoing description. Accordingly, the invention is intended to embrace all such alternatives, modifications, and variations falling within the spirit and scope of the appended claims.

What is claim is:

1. A nail care tool useful for removing nail polish, buffing, and cleaning fingernails, toenails, and their surrounding areas thereof, said tool comprising:

A. a handle section comprising:

a single ergonomic, elongated, integral body, comprising an external configuration having a first cylindrical elongated section having a free end, a second cylindrical elongated section having a wider diameter than the first cylindrical elongated section, following the first cylindrical section, having no exit to the exterior of the handle, and a third elongated section having four identical rectangular sides following the second cylindrical section, ending with a flat square end and having no exit to the exterior of the handle;

(a) a male-connecting unit, having an elongated body protruding outwardly from the center of said flat square end and having no exit to the exterior of said elongated body;

(b) an internal cavity projected inwardly from the free end of the first cylindrical section and into said first cylindrical section, having an exit outwardly oriented into the free end of the first cylindrical body and positioned at the opposite side of the male-connecting unit;

wherein the only exit to the exterior in said single ergonomic, elongated, integral body is the exit of said internal cavity;

B. a single head section comprising:

(a) a main body, said body comprising:

i) a bottom section having a flat configuration;

ii) a lateral section, formed by sides extending upwardly from edges of said bottom section and having an external surface and an internal surface;

iii) a top section having an external surface and an internal surface that encloses edges of sides of said lateral section, creating said main body;

iv) a single female-connecting unit having an internal cavity projected inwardly from the bottom section and into the interior of the main body and having a single exit outwardly oriented toward the bottom section;

wherein an only exit to the exterior of said main body is an exit of the internal cavity of the single female-connecting unit; and (b) an operational material, covering at least all the external surface of the lateral section of the main body; and wherein the male-connecting unit and the female-connecting unit constitute a single male/female connecting system that non-permanently connects the head section to the handle section.

2. The nail care tool as recited in claim 1, further comprising a scraper section having an elongated cylindrical body with first pointy end and a second diagonal end inserted in a non-permanent manner into cylindrical cavity located at the first end located at the cylindrical section of the handle section.

3. The nail care tool as recited in claim 1, further comprising a head cap simulating the shape of the main body of the head section.

4. The nail care tool as recited in claim 1, wherein the male-connecting unit and the female-connecting unit are threaded.

5. The nail care tool as recited in claim 1, wherein the operational material fixed to the external surface of the main body of the head section comprises a suitable material capable of absorbing and retaining fluids.

6. The nail care tool as recited in claim 5, wherein the suitable material capable of absorbing and retaining fluids used as operational material is selected from felt, polyester, polypropylene, cotton, sponge, or any combination thereof.

7. The nail care tool as recited in claim 5, wherein the main body of the head section comprises a single unit body with an external geometrical shape having a tridimensional rectangular section with curved or concave lateral sides that are extended continuously forming a four sides pyramidal shape top section.

8. The nail care tool as recited in claim 5, wherein the main body of the head section comprises a single unit body with an external geometrical shape having a tridimensional triangular section with curved or concave lateral sides that are extended continuously forming a three sides pyramidal shape top section.

9. The nail care tool as recited in claim 5, wherein the main body of the head section comprises an external geometrical shape having a tridimensional triangular section with flat lateral sides that are extended continuously forming a three sides pyramidal shape top section.

10. The nail care tool as recited in claim 5, wherein the main body of the head section comprises a single unit body with an external geometrical shape having a tridimensional rectangular section with two curved or concave lateral sides and two flat lateral sides that are extended continuously forming a four sides pyramidal shape top section.

11. The nail care tool as recited in claim 1, wherein the operational material fixed to the external surface of the main body of the head section comprises an abrasive buffing material.

12. The nail care tool as recited in claim 11, wherein the main body of the head section comprises a single unit body with an external geometrical shape having a tridimensional rectangular section with flat sides.

13. The nail care tool as recited in claim 11, wherein the main body of the head section comprises a single unit body with an external geometrical shape having a tridimensional rectangular section with concave lateral sides.

14. The nail care tool as recited in claim 11, wherein the main body of the head section comprises a single unit body with an external geometrical shape having a tridimensional triangular section with flat lateral sides.

15. The nail care tool as recited in claim 11, wherein the main body of the head section comprises a single unit body with an external geometrical shape having a tridimensional triangular section with concave lateral sides.

* * * * *